US009196230B1

(12) United States Patent
Elliot

(10) Patent No.: US 9,196,230 B1
(45) Date of Patent: Nov. 24, 2015

(54) SYMPATHETIC PARALLEL PLATE RESONATOR FOR ACOUSTIC INSTRUMENTS

(71) Applicant: Jerry C Elliot, Oklahoma City, OK (US)

(72) Inventor: Jerry C Elliot, Oklahoma City, OK (US)

( * ) Notice: Subject to any disclaimer, the term of this patent is extended or adjusted under 35 U.S.C. 154(b) by 0 days.

(21) Appl. No.: 14/329,147

(22) Filed: Jul. 11, 2014

(51) Int. Cl.
*G10D 3/02* (2006.01)

(52) U.S. Cl.
CPC ..... *G10D 3/02* (2013.01)

(58) Field of Classification Search
CPC ..... G10D 3/02
See application file for complete search history.

(56) References Cited

U.S. PATENT DOCUMENTS

| | | | | | |
|---|---|---|---|---|---|
| 729,230 | A * | 5/1903 | Smith | 84/277 | |
| 3,233,495 | A * | 2/1966 | Bernardi | 84/294 | |
| 3,314,324 | A * | 4/1967 | Williams | 84/294 | |
| 3,678,794 | A * | 7/1972 | Tansky | 84/275 | |
| 3,956,963 | A * | 5/1976 | Milton | 84/296 | |
| 4,320,684 | A * | 3/1982 | Podunavac | 84/291 | |
| 4,903,567 | A * | 2/1990 | Justus | 84/294 | |
| 6,681,661 | B2 * | 1/2004 | Lalonde | 84/267 | |
| 7,259,308 | B2 * | 8/2007 | Geiger | 84/294 | |
| 8,278,538 | B1 * | 10/2012 | D'Anda et al. | G10D 3/02 84/267 | |
| 2005/0076763 | A1 * | 4/2005 | Langeman | 84/290 | |
| 2010/0083806 | A1 * | 4/2010 | Peavey | 84/294 | |

* cited by examiner

*Primary Examiner* — Robert W Horn
(74) *Attorney, Agent, or Firm* — James Robert Johnson

(57) ABSTRACT

The disclosed invention is provides a simple, easily installed means to produce an improved quality of sound timbre in acoustic instruments at increased volume and increased audible sustain by the removable attachment of a suitable sympathetic resonator.

11 Claims, 6 Drawing Sheets

SYMPATHETIC PARALLEL PLATE RESONATOR FOR ACOUSTIC INSTRUMENTS

BACKGROUND OF THE INVENTION

Acoustic instruments rely on mechanical means to create and amplify sound. Acoustic guitars, for example, use strings, held under tension, and placed over a cavity. When vibrated, the strings transmit some of the energy of the vibration into the saddle, which then transmits energy into the bridge. Some of this energy is then transmitted into the hollow body of the guitar, where the air molecules in the body begin to vibrate. The sound is then passed out to the listener through the opening in the body of the guitar. No actual amplification of the sound occurs. The guitar is built to convert the energy of the string vibration into sound in a somewhat optimized way.

There are limits to this mechanical amplification. The efficiency of energy transfer from the strings to the body of the guitar depends on such factors as the method of bridge attachment and the quality of wood used to make the guitar. Characteristics of the guitar body will also affect the transfer of energy. Guitars can be built to have exceptional sound quality and energy transfer. These guitars can be very expensive and well outside the range of affordability of many players. Options to improve the sound creation of average guitars are limited, despite that people of more modest means may equally appreciate quality sound from a musical instrument.

Although guitars are identified here as an area of need for the present invention, the invention may be practiced on a range of acoustic instruments for which a targeted amount of sympathetic vibration may improve sound quality, including basses, banjos and non-string acoustic instruments.

There is a need for an easily attachable device suitable to capture more energy from string vibration to produce a louder, higher quality sound from acoustic instruments. There is a further need for such a device which can be installed either in new instruments or as an aftermarket improvement.

BRIEF SUMMARY OF THE INVENTION

An object of the invention is an easily manufactured device which uses no high tech materials or complicated processes, one that is quick to mass produce and which still provides improvement in sound quality in acoustical instruments. Described herein is a device suitable to improve the sound quality (or timbre), sustain of audible tones, and provide small amplification of a conventional acoustic instrument (guitar, ukulele, harp, violin, viola, basses etc.)

In the preferred embodiment, a thin parallel resonator plate, generally trapezoidal in geometry but with an option to use other geometric configurations, is removeably affixed beneath and centered to the guitar bridge. Thus placed, the device is beneath the plurality of guitar strings and placed beneath the surface of the guitar top. Accordingly, the device is mounted and attached to the top of the guitar, passing through the guitar top (soundboard) and into two holes in the guitar bridge by one dowel forming the attaching function. The device and attachment support dowels are preferably made of the same wood materials and density as the guitar top to maximize the absorptivity of vibrational energy by the device, resulting in an increase of vibrational energy converted to sound.

A sympathetic vibration is a vibration that is sympathetic (in tune or forming unisons) to or between two or more individual objects' vibrational fundamentals and/or their harmonics. It is the driving of a mechanical or acoustical system at its resonant frequency by energy from an adjacent system vibrating at this same frequency.

A vibration produced in an object which resonates at the same frequency, or a harmonic multiple thereof, as that present in a sound wave in contact with the object, the device is set into vibratory motion by the transfer of vibrations originating from the pick or pluck of strings which transfer into the contact point at the guitar saddle. The saddle is inset into the guitar bridge, which, in turn, transfers the vibrations onto the guitar top, and either down the support dowels onto the device or via air molecule vibration from the bridge and guitar top into the device. The guitar top effectively reverberates and transfers to the air the surface acoustic waves, which are then routed onto the resonator plate. In the preferred embodiment, the plate resonator is shaped substantially as a trapezoid. The resonator plate vibrates in sympathetic vibration and transfers surface acoustic waves to the air.

When a mechanical or acoustical system is acted upon by an external periodic driving force whose frequency equals a natural free oscillation frequency of the system, the amplitude of oscillation becomes large and the system is said to be in a state of resonance. Resonance or co-vibration is the name given to the phenomenon of one vibrating body imparting its vibratory movement to another body, previously at rest. To obtain the maximum resonance two conditions are essential:

1) The two bodies must be in exact unison; that is to say, they must be capable of executing precisely the same number of vibrations in the same time.

2) A certain period of time must be allowed for the exciting body to impress its vibrations on the other.

The support dowels are strategically placed and centered below the saddle and bridge where hush surface acoustic waves are generated and available for uptake by the device and resonance. When a string is plucked or picked, the saddle and bridge vibrate in response to the surface waves from the guitar top and routes them to the resonator plate, where the acoustic surface waves are transferred to the air and resonated back into the surface of the guitar top. As the top resonates, the vibrations are again redirected to the underneath surface of the guitar top and routed to the parallel resonator plate. This coupling resonance phenomenon continues to cycle until the sound vibrations are eventually damped and become inaudible.

The use of different size and geometry timbre plates allows the guitarist or instrumentalist to vary the timbre or the characteristic sound of a conventional guitar. A timbre piece may be made of various materials, including but not limited to wood, metal, paper and plastic, and have various shapes, including but not limited to octagons, pentagons, squares, rectangles, trapezoids, ovals, and circles.

The present invention achieves quality resonance and amplification of guitar sound by resonating the lush guitar sound with the aid of the plate resonator. The present invention also provides means to easily modify existing instruments by inserting an aftermarket or retrofit kit.

An objective is to easily manufacture a device which uses no high tech materials or complicated processes, and one that is quick to mass produce revolutionary improvement in sound quality in acoustical instruments.

The general idea is to mechanically increase the sound quality or timbre by using a low-cost, lightweight, easy-to-apply assist device to increase the sound sustain of the instrument and lengthen and prolong the damping time of frequencies thus resulting in sustained sounds.

New acoustic musical instruments and those already manufactured can improve their sound quality by use of the invention, which is much sought after by instrumentalists.

DETAILED DESCRIPTION OF THE INVENTION

Figure 1:
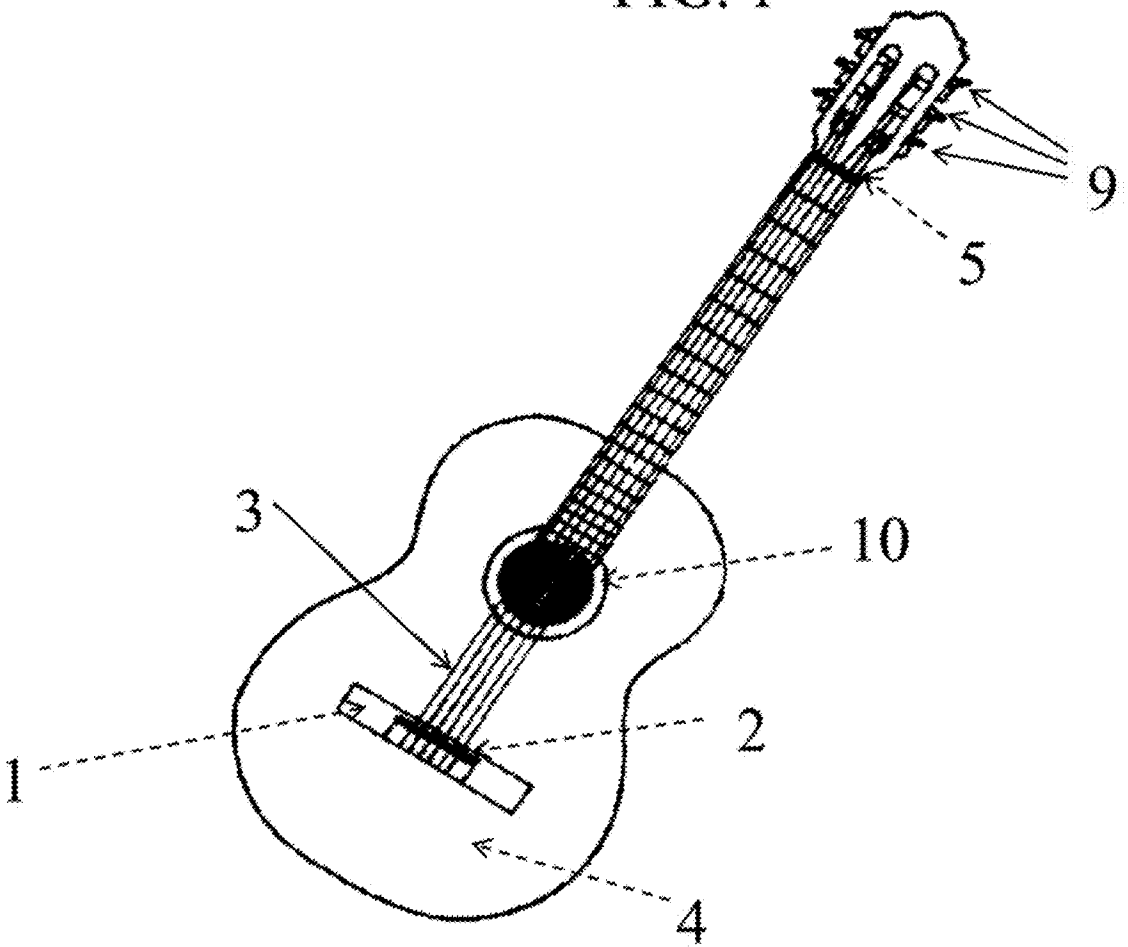
FIG. 1 depicts a top view of a conventional acoustic guitar, including the main sound producing elements.

Referring to FIG. 1, in a standard acoustic guitar, strings 3 are attached at tuning posts 9, fixed at the nut 5 and then fixed again at the saddle 2 and then attached at the bridge 1. Pitch is changed by the tuning of the strings 3 using the tuning posts 9 and then by fingering using frets, but this level of understanding is not necessary for this invention.

Figure 2:
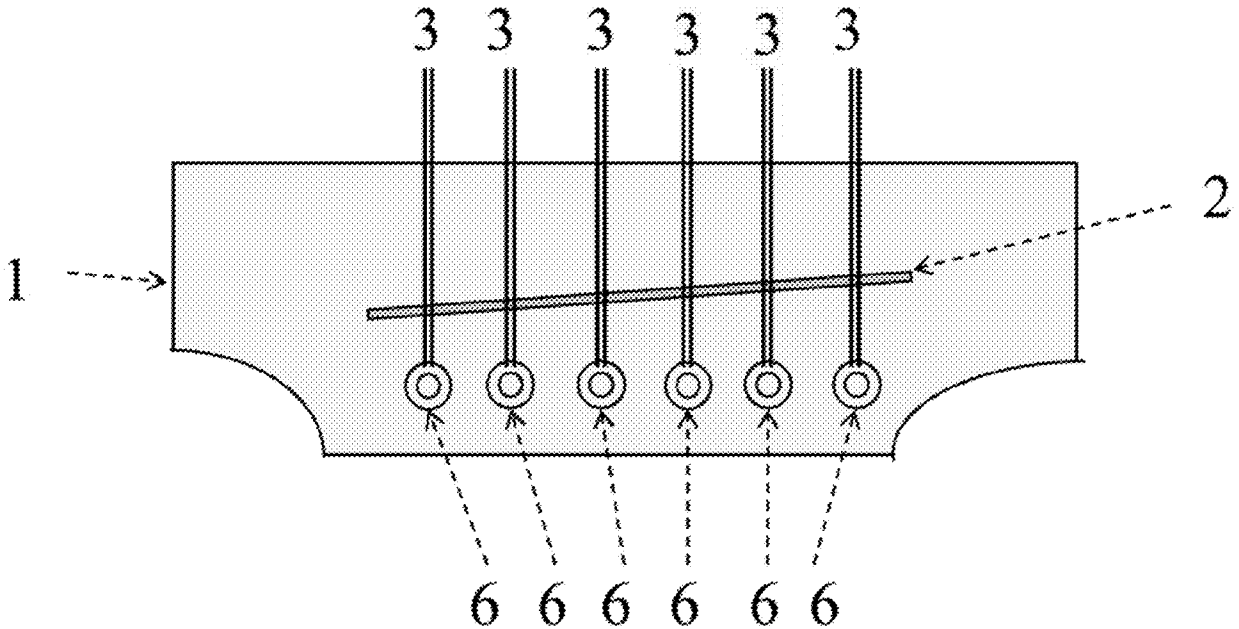
FIG. 2 depicts a detailed partial top view of the bridge and saddle of a conventional guitar.

Referring to FIG. 2, more particular to FIG. 1, strings 3 are attached at the bridge 1 using bridge pins 6, one for each string 3. When a string 3 is vibrated by being plucked or strummed, some of the energy of the vibration is transferred into the saddle 2 and then into the bridge 1. This is accomplished primarily by the direct contact between the strings 3, the saddle 2, the bridge 1 and guitar top 4.

Figure 4:
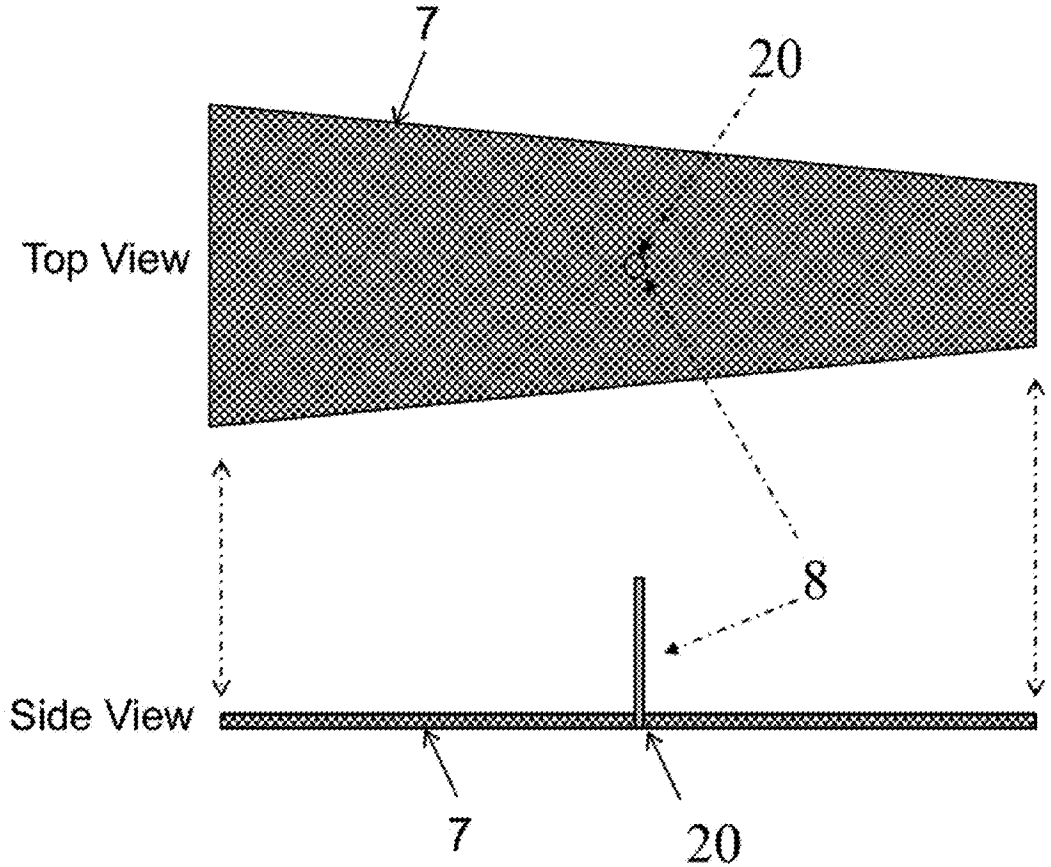
FIG. 4 depicts a top and side views of a trapezoidal shaped device showing a single installed support dowel.

Referring to FIG. 4, a typical plate resonator 7 is shown. It is well known in the industry that a plucked string vibrates in a range of frequencies, including a mix of a dominant and multiple harmonics. Strings of different compositions typically exhibit different harmonics. Thus, a piano sounds different from a guitar (although multiple reasons for this exist). The aspect of this significant to this invention is that the shape of the plate resonator 7 will have an impact on the sound improvement. A plate resonator 7 of one shape, such as the trapezoid shown in FIG. 4, will be sympathetic to a different set of dominant and harmonic frequencies that a plate resonator 7 of a different shape.

Figure 3:
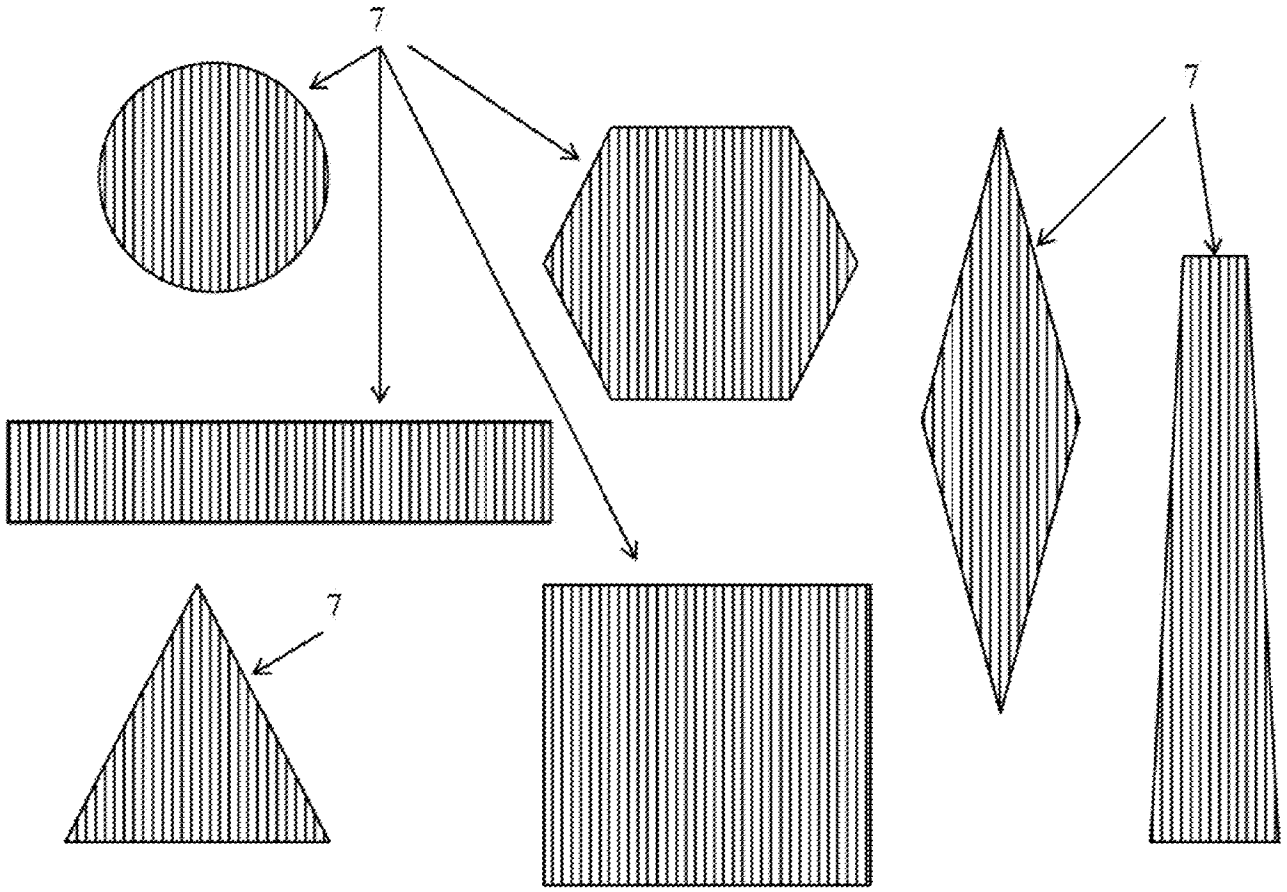
FIG. 3 depicts different exemplary device shapes.

FIG. 3 depicts plate resonators 7 of various optional shapes. No limit to the specific size and shape of plate resonator 7 is set.

Referring back to FIG. 4, an exemplary mounting method is depicted. A single dowel 8 is inserted into a hole 20 of suitable size drill into the plate resonator 7. Optimally, the dowel 8 is perpendicular to the plate resonator 7 so as to allow the plate resonator 7 to be mounted in the guitar body parallel to the guitar top 4.

Figure 5:
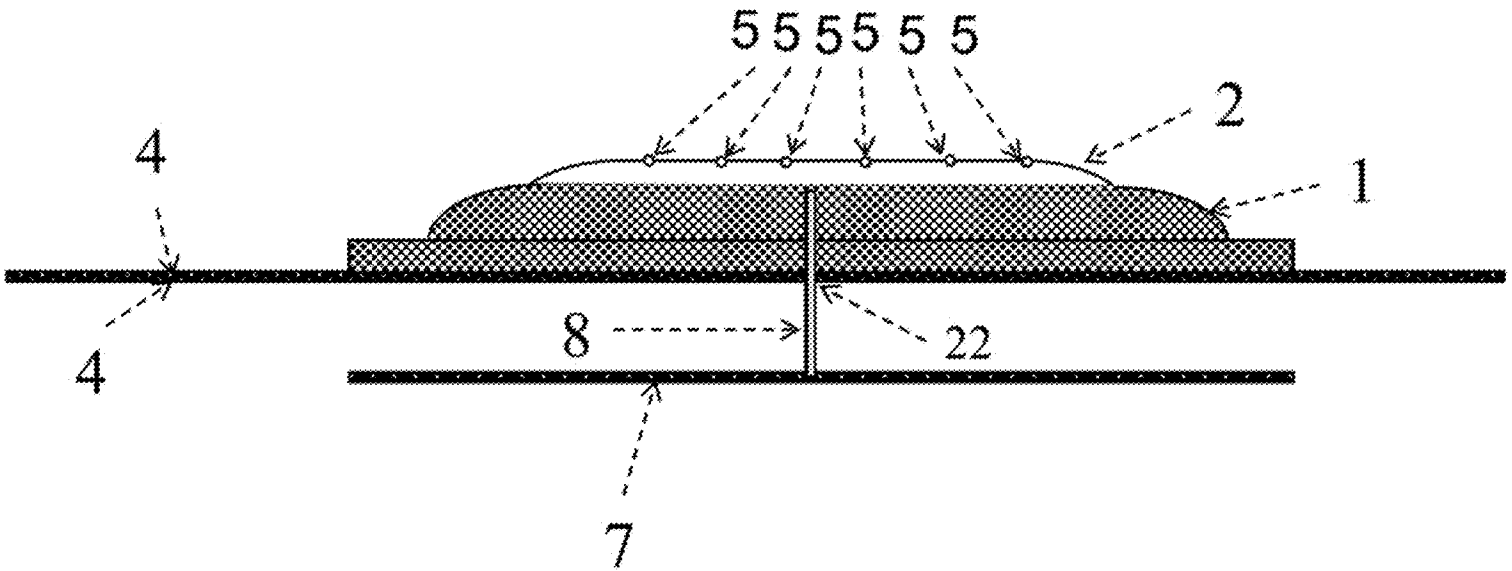
FIG. 5 depicts a cutaway view of the device in use with a conventional guitar in which one dowel provides support
Figure 6:
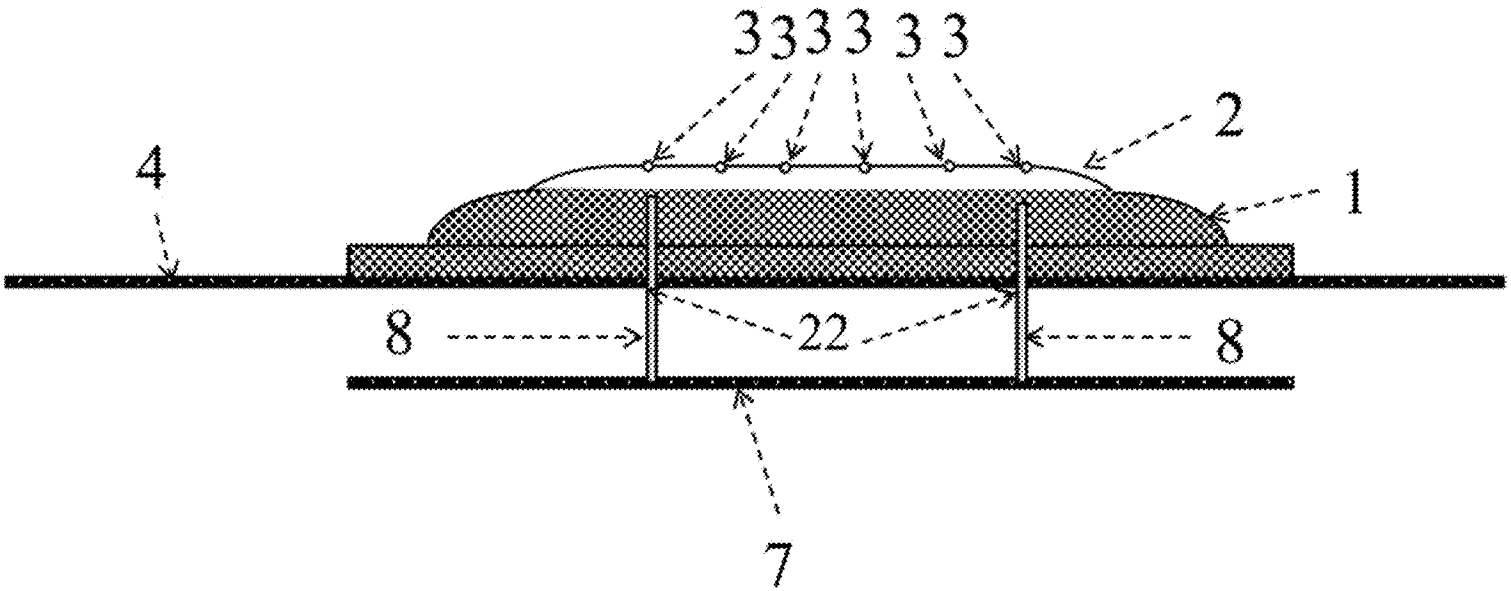
FIG. 6 depicts a perspective view of the upper surface of the guitar top and the underneath surface of the guitar top, particularly illustrating the contact between the guitar bridge and two support dowels attached to the device, placed within the guitar, and mounted parallel to the guitar bridge directly beneath and parallel to it.

Referring to FIG. 5, the device is shown mounted in a guitar. Mounting may be accomplished either by the guitar maker at a shop or factory or by the end user. As shown in FIG. 6, a hole 22 of suitable size is drilled through bridge 1 and guitar top 4. This hole 22 should be drilled perpendicular to the guitar top 4, again, to allow the plate resonator 7 to be mounted parallel to the guitar top 4.

The dowel 8 is then inserted into the hole 22 extending completely into the guitar body. The plate resonator 7 is the passed through the guitat top hole 10 (from FIG. 1). The dowel 8 is then inserted into hole 20 on plate resonator 7. The plate resonator 7 is manually positioned by the user to a desired orientation relative to the bridge 1 and saddle 2. For example, the plate resonator 7 may be oriented parallel to the bridge 1 and saddle 2 or, in the alternative, perpendicular.

Referring now to FIG. 6, an alternate embodiment of the device is depicted. In this embodiment, a set of two support dowels 8 is used to mount the plate resonator 7. In this embodiment, two holes 22 are drilled through the bridge 1 and guitar top 4. In this FIG. 6, the orientation of the holes 22 is parallel to and along the long axis of the bridge 1. When using two dowels 8, the user must decide on an orientation for mounting prior to drilling, although multiple dowel 8 holes 22 may be drilled into the bridge 1 and guitar top 4.

Similar dowel 8 holes 22 may be drilled into other types of drillable acoustic instruments, not shown.

When a guitar string is picked, the vibration produces a standing wave on the string. The fixed points of the string don't move (nodes), while other points on the string oscillate back and forth maximally (forming antinodes).

A vibration is produced in the plate resonator 7 by the vibrations of the same frequency, or a harmonic multiple of that frequency, from a sound wave in contact with the plate resonator 7, by means of the bridge 1, saddle 2 and support dowel(s) 8. In physics, vibration is commonly referred to as an oscillation.

Although the plate resonator 7 and dowels 8 have been described herein as being constructed of wood and in particular as the same wood as the body of the guitar, alternate materials are possible, including, without limitation, plastics and metals.

I claim:

1. A shaped, thin plate resonator made of wood or metal suitable for removable mounting in the interior of a stringed acoustic instrument wherein the resonator is removably mounted through the top of the stringed acoustic instrument below the bridge having a thickness; and wherein the resonator is removably mounted using one or two small diameter dowels into holes penetrating the combination of the soundboard and bridge.

2. The resonator of claim 1 in which the acoustic instrument is a guitar.

3. The resonator of claim 1 in which the resonator is formed into different geometrical shapes depending on the perceived sound quality desired.

4. The resonator of claim 3 in which the shape of the resonator is circular.

5. The resonator of claim 3 in which the shape of the resonator is elliptical.

6. The resonator of claim 3 in which the shape of the resonator is rectangular.

7. The resonator of claim 3 in which the shape of the resonator is square.

8. The resonator of claim 3 in which the shape of the resonator is diamond.

9. The resonator of claim 3 in which the shape of the resonator is trapezoidal.

10. The resonator of claim 1 in which the resonator is sized for removable insertion into the sound hole of a stringed acoustic instrument.

11. The resonator of claim 1 in which the resonator may be made of plastic or paper.

* * * * *